US009272178B2

(12) United States Patent
Pinder

(10) Patent No.: US 9,272,178 B2
(45) Date of Patent: Mar. 1, 2016

(54) RESISTANCE TRAINING DEVICE

(71) Applicant: Roger Pinder, Aloha, OR (US)

(72) Inventor: Roger Pinder, Aloha, OR (US)

( * ) Notice: Subject to any disclaimer, the term of this patent is extended or adjusted under 35 U.S.C. 154(b) by 0 days.

(21) Appl. No.: 14/628,515

(22) Filed: Feb. 23, 2015

(65) Prior Publication Data

US 2015/0251040 A1 Sep. 10, 2015

Related U.S. Application Data

(60) Provisional application No. 61/947,584, filed on Mar. 4, 2014.

(51) Int. Cl.

| | |
|---|---|
| ***A63B 21/02*** | (2006.01) |
| ***A63B 21/055*** | (2006.01) |
| ***A63B 21/04*** | (2006.01) |
| *A63B 21/16* | (2006.01) |

(52) U.S. Cl.

CPC ..... *A63B 21/0557* (2013.01); *A63B 21/0407* (2013.01); *A63B 21/02* (2013.01); *A63B 21/04* (2013.01); *A63B 21/055* (2013.01); *A63B 21/0552* (2013.01); *A63B 21/16* (2013.01); *A63B 21/4025* (2015.10); *A63B 21/4039* (2015.10)

(58) Field of Classification Search

CPC ..... A63B 5/20; A63B 5/205; A63B 21/00; A63B 21/0004; A63B 21/00043; A63B 21/00178; A63B 21/00181; A63B 21/00185; A63B 21/002; A63B 21/0023; A63B 21/02; A63B 21/021; A63B 21/026; A63B 21/028; A63B 21/04; A63B 21/0407; A63B 21/0428; A63B 21/0435; A63B 21/0442; A63B 21/055; A63B 21/0552; A63B 21/0555; A63B 21/0557; A63B 21/16; A63B 21/1609; A63B 21/1618; A63B 21/1627; A63B 21/1636; A63B 21/1645; A63B 21/1654; A63B 21/1663; A63B 21/1672; A63B 21/1681; A63B 21/169; A63B 21/28; A63B 21/285; A63B 21/4001; A63B 21/4003; A63B 21/4005; A63B 21/4007; A63B 21/4009; A63B 21/4011; A63B 21/4013

USPC ..... 482/121–122, 124–125

See application file for complete search history.

(56) References Cited

U.S. PATENT DOCUMENTS

| | | | | | |
|---|---|---|---|---|---|
| 3,069,169 | A * | 12/1962 | Topping | A63B 69/0059 | 473/212 |
| 4,544,155 | A * | 10/1985 | Wallenbrock | A63B 21/04 | 473/213 |
| 4,762,318 | A * | 8/1988 | Phillips | A63B 21/0004 | 24/115 L |
| 4,863,163 | A | 9/1989 | Wehrell | | |

(Continued)

*Primary Examiner* — Oren Ginsberg
*Assistant Examiner* — Joshua Lee
(74) *Attorney, Agent, or Firm* — Daniel Boudwin; Global Intellectual Property Agency LLC

(57) ABSTRACT

A resistance training device is provided that comprises a waist harness, one or more limb harnesses, and one or more elongated resistance bands disposed therebetween. The bands are secured at each end by retainer assemblies comprising a ring device disposed within a clamshell retainer housing, whereby the ring supports the band at one end and secures to a D-link at an opposite end. The bands are removable from the rings, while the rings may also be removable from the D-links. The D-links are disposed on the limb harnesses and the waist harness, whereby the limb harness is secured to a foot or arm portion while the waist harness secures around the torso of the wearer. In this way the resistance bands are anchored to the user, who can engage in stretching or strength training exercises by stretching the band between the harnesses.

6 Claims, 4 Drawing Sheets

(56) References Cited

U.S. PATENT DOCUMENTS

| | | | | |
|---|---|---|---|---|
| 4,910,802 | A | 3/1990 | Malloy | |
| 5,597,376 | A | 1/1997 | Bode | |
| 5,716,307 | A | 2/1998 | Vadher | |
| 7,608,026 | B1 * | 10/2009 | Nicassio | A63B 21/00185 24/265 BC |
| 7,749,140 | B1 * | 7/2010 | Lindemeier | A63B 21/4017 482/126 |
| 8,348,814 | B1 * | 1/2013 | Hinds | A63B 7/02 482/82 |
| 8,944,975 | B2 * | 2/2015 | Hsieh | A63B 21/0442 482/124 |
| 8,961,379 | B2 * | 2/2015 | Flentye | A63B 21/0552 482/121 |
| 2005/0137066 | A1 * | 6/2005 | Wu | A63B 21/0004 482/126 |
| 2010/0167885 | A1 * | 7/2010 | Kassel | A63B 21/00043 482/121 |
| 2010/0317495 | A1 * | 12/2010 | DiGiovanni | A63B 21/0552 482/129 |
| 2011/0092347 | A1 * | 4/2011 | Kassel | A63B 21/0552 482/121 |
| 2012/0202658 | A1 | 8/2012 | Menefee | |
| 2012/0245002 | A1 * | 9/2012 | Todd | A63B 21/4025 482/124 |
| 2013/0116098 | A1 * | 5/2013 | Lee | F16B 2/10 482/121 |
| 2013/0185900 | A1 * | 7/2013 | Campbell | F16G 11/101 24/301 |
| 2013/0244840 | A1 * | 9/2013 | Thompson | A63B 5/16 482/93 |
| 2013/0288864 | A1 * | 10/2013 | Holland | A63B 21/4023 482/126 |
| 2013/0303344 | A1 * | 11/2013 | Rasnake | A63B 21/02 482/124 |
| 2014/0142864 | A1 * | 5/2014 | Spears | A61B 5/1118 702/19 |
| 2015/0005143 | A1 * | 1/2015 | Liu | A63B 21/0557 482/129 |
| 2015/0072840 | A1 * | 3/2015 | Poe | A63B 21/0557 482/122 |

* cited by examiner

RESISTANCE TRAINING DEVICE

CROSS REFERENCE TO RELATED APPLICATION

This application claims the benefit of U.S. Provisional Application No. 61/947,584 filed on Mar. 4, 2014. The above identified patent application is herein incorporated by reference in its entirety to provide continuity of disclosure.

BACKGROUND OF THE INVENTION

Field of the Invention

The present invention relates to exercise and stretching equipment. More specifically, the present invention relates to a body-worn assembly that affixes one or more limbs to the waist of the wearer for stretching and exercising the user's muscles via resistance bands.

Resistance training is a common method of exercising and stretching different muscle groups of the body. Resistance training generally involves use of elastic resistance bands that provide linear or progressive resistance as one or more of the bands are tensioned by the user. Such means of exercise are sometimes deployed in conjunction with exercise machines, but are also often deployed by an individual using the bands by themselves. The user can stretch the bands between portions of the body or utilize external supports as an anchor for one end of the band as it is worked upon.

Resistance training is popular because allows targeting of specific muscle groups of the body and eliminates the need for large weights. The bands allow the user to put traction on their muscles without relying on gravity for the exercise. While existing resistance bands are useful and widely utilized, there exists a need for a resistance band assembly that can be used to target various portions of the body without relying on external support, and furthermore while providing stable anchoring of the bands on a user's person without fear of accidental release.

The present invention provides such a solution whereby a resistance band assembly is disclosed that can secure one or more bands between the waist and limbs of a wearer. The assembly includes a waist harness that secures around the torso of the wearer, one or more resistance bands, and one or more limb harnesses that are used to secure to the ends of individual limbs. The resistance bands are secured at each end using attachment rings and clamshell retainers. The bands are releasable from the retainers such that bands of different resistance can be substituted when more or less resistance is desired. In use, the assembly is tensioned by the limbs and core of the wearer, allowing for targeted exercises and stretching activities.

SUMMARY OF THE INVENTION

In view of the foregoing disadvantages inherent in the known types of resistance training devices now present in the prior art, the present invention provides a new training device that can be utilized for providing convenience for the user when training or stretching using resistance bands.

It is therefore an object of the present invention to provide a new and improved resistance training device that has all of the advantages of the prior art and none of the disadvantages.

It is another object of the present invention to provide a resistance training device that includes a waist harness and one or more limb harnesses that can operably support resistance bands therebetween for stretching and strength training exercises.

Another object of the present invention is to provide a resistance training device that securely anchors resistance bands between the waist and limbs of the user, thereby preventing accidental release and injury.

Yet another object of the present invention is to provide a resistance training device that includes retainer assemblies that removably support the ends of resistance bands, whereby the bands can be removed and replaced with the resistance of choice for the given activity.

Another object of the present invention is to provide a resistance training device that may be readily fabricated from materials that permit relative economy and are commensurate with durability.

Other objects, features and advantages of the present invention will become apparent from the following detailed description taken in conjunction with the accompanying drawings.

BRIEF DESCRIPTIONS OF THE DRAWINGS

Although the characteristic features of this invention will be particularly pointed out in the claims, the invention itself and manner in which it may be made and used may be better understood after a review of the following description, taken in connection with the accompanying drawings wherein like numeral annotations are provided throughout.

DETAILED DESCRIPTION OF THE INVENTION

Figure 1:
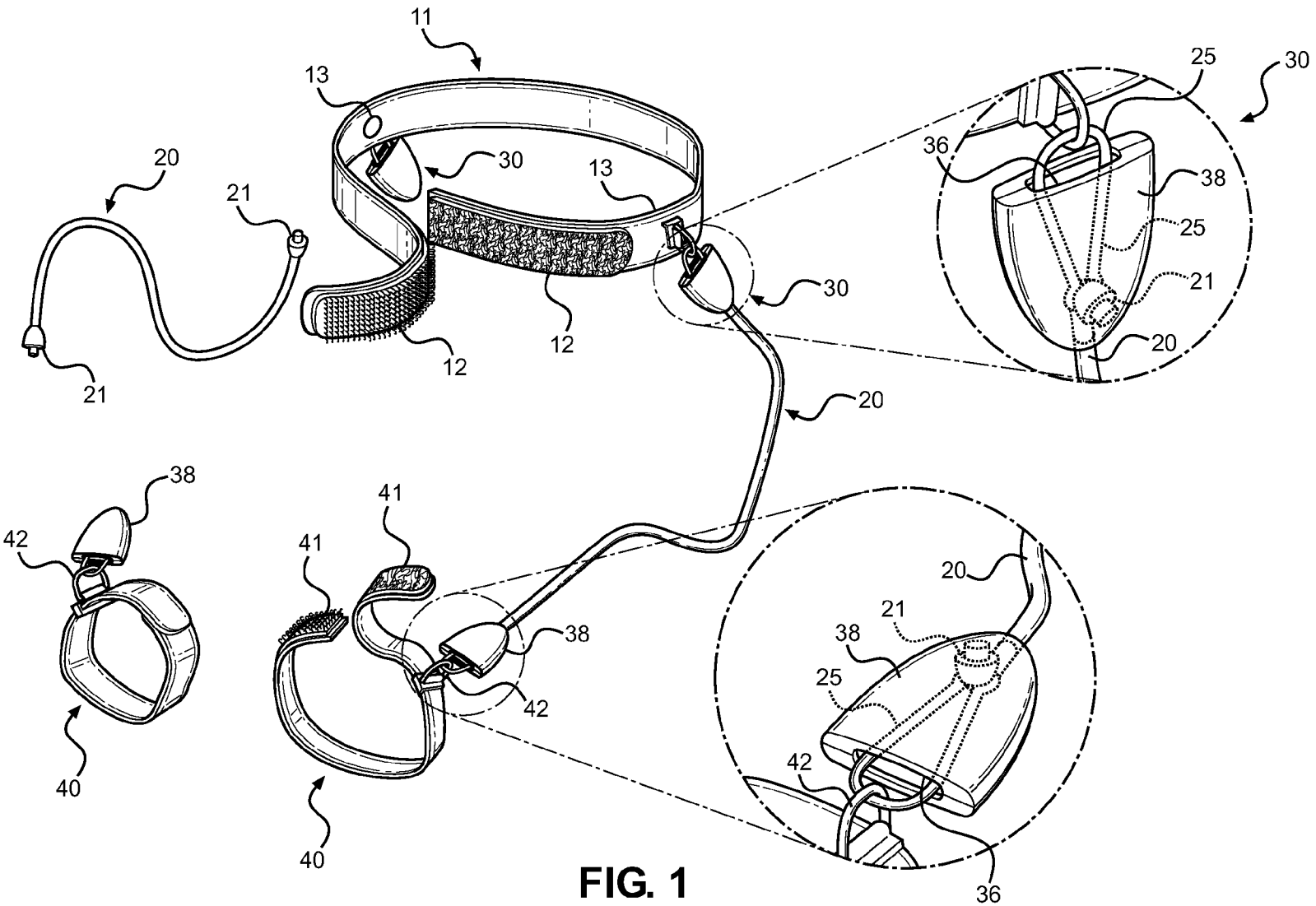
FIG. 1 shows an exploded view of the elements of the resistance training device of the present invention.

Reference is made herein to the attached drawings. Like reference numerals are used throughout the drawings to depict like or similar elements of the resistance training device of the present invention. For the purposes of presenting a brief and clear description of the present invention, the preferred embodiment will be discussed as used for stretching or strength training using elongated resistance bands disposed between the torso and limbs of the user. The figures are intended for representative purposes only and should not be considered to be limiting in any respect.

Referring now to FIG. 1, there is shown an exploded view of the resistance training device of the present invention. The device comprises a waist harness 11 that is configured to circumscribe and secure to the torso of a wearer and provide an anchor point for one or more resistance bands 20 extending therefrom. The waist harness 11 comprises an elongated strap having a first and second end with end connector 12 thereon that secure the first and second end together along the torso of the wearer. The connectors 12 may comprise hook and loop fasteners as shown in FIG. 1, or alternatively may comprise other strap end attachment means, such as a buckle, a ratchet fastener, snaps, or like connectors that provide a temporary yet rigid connection.

The elongated waist harness 11 comprises a length, along which are disposed at least one connection point 13 for a retainer assembly 30. The connection point 13 preferably comprises a closed link attachment point. More specifically, the connection point preferably comprises a D-link member 42 that is affixed to the harness 11 and provides an enclosed ring attachment for the retainer assemblies 30, which removably affix thereto. The D-links 42 include a straight member and a curved member forming a substantial D-shape. The straight member is secured using a sewn portion of material extending over the straight member, or alternatively using a mechanical fastener that secures through the connection point 13 along the waist harness 11. The D-link provides an anchor location at which a resistance band 20 affixes to the waist harness 11 using a retainer assembly 30.

The resistance bands 20 are elongated, elastic members have a stiffness and an elastomeric property that permits each band 20 to elongated and stretch relative to its static condition without breaking or fracturing. Resistance band material contemplated is known in the art of physical exercise devices and resistance training tools. The present invention utilizes a rubberized or elastomeric material formed into an elongated member having a pair of ends 21. The ends 21 are unique in that they terminate in a bulb configuration that is suitable for being retained with a rounded retainer ring 25.

The resistance band ends 21 of the present invention are designed to be supported by the retainer assemblies 30, which comprise retainer ring device 25 supported within a clamshell retainer housing 38. The retainer ring 25 is a closed ring having a first and second rounded portion within which one end 21 of a resistance band 20 is first received, and then secured. The bulb end 21 of the resistance band preferably comprises a portion of the band having an enlarged diameter or thickness, which flares outward at each end 21. This area of increased thickness relative to the thickness along the band length allows the retainer ring 25 to secure the band end 21 therein when inserted into the ring 25 interior and tensioned therefrom such that the bulb 21 bears against the ring 25

Each retainer ring 25 includes first rounded portion that is enlarged and includes a large open interior. The ring 25 comprises a bar structure forming the first rounded portion and then flaring outward along the base of the ring 25 to form a second, smaller rounded portion that is suited to prevent the bulb end 21 of the resistance band 20 from sliding therethrough. Therefore, the first rounded portion receives the bulb end 21 of the resistance band therethrough, whereafter the base of the bulb end 21 (i.e. at the intersection between the band length and the bulb end) is moved within the ring interior to the second, smaller rounded portion and tensioned thereagainst. The smaller opening provided by the second rounded portion prevents the bulb end 21 from being pulled therethrough, and therefore locks the bulb in place and anchors the resistance band from the retainer ring when stretched and elongated during an exercise.

To prevent the resistance band from moving which engaged with the retainer ring 25 during an exercise, a clamshell retainer housing 30 is positioned over the retainer ring 25 and the bulb end 21. The housing 30 encloses the connection between the ring 25 and resistance band 20, thereby preventing any movement of the bulb end 21 from the smaller ring when the band is not being actively tensioned. The housing 30 includes two halves, a lower opening for the band 20 to be received therethrough, and a retainer ring opening 36 allowing the first rounded end 29 of the retainer ring 25 to extend and affixed around a D-link 42 on either the waist harness or one of the limb or leg harnesses 40.

The limb and leg harnesses 40 may be one in the same or variants of one another, whereby each harness 40 comprises an elongated length, a first and second attachable end, and one or more D-link attachments 42. Similarly, the waist and limb/leg harnesses may be similar to each other or minor variants of one another, whereby the size and interior padded within the harness may have different configurations. The waist and limb/leg harnesses will be defined as body harnesses, while the limb and leg harnesses 40 will be defined simply as limb harnesses for simplicity. Each of the body harnesses are elongated straps that are designed to secure around a portion of the user's body. This includes the torso, arms, hands, head, portions of the leg, or feet of the wearer while engaged in the exercise activity. Like the waist harness, the ends of the limb harnesses 40 include fasteners 41 of similar detail, whereby hook and loop fasteners or equivalent fasteners are contemplated for securing the ends together while exercising. The D-links 42 therealong provide an anchor point to which the retainer assemblies 30 connect.

Therefore, the resistance bands 20 are supported at both ends between different portions of the user's body and are stretched to exercise and stretch the user. The waist band 11, while suited and sized for the torso of the wearer, may also be affixed to other parts of the body. Likewise, the limb harnesses 40 may be affixed to different portions of the body and may alternatively be used in pairs without the waist harness 11 altogether. Several variations of the assembly configuration are possible. These include different attachment areas for the limb and waist harnesses, different resistance bands, several resistance bands being used between a pair of D-links, and so on. The present invention provides versatility in its use by providing a resistance training system that can connect and detach easily in different forms. It is not desired to limit the type of exercise or the arrangement of the harnesses and bands relative to the user, but rather it is desired to disclose a novel assembly that affords a resistance training tool that is safely and securely anchored to the user while stretching or exercising.

Figure 2:
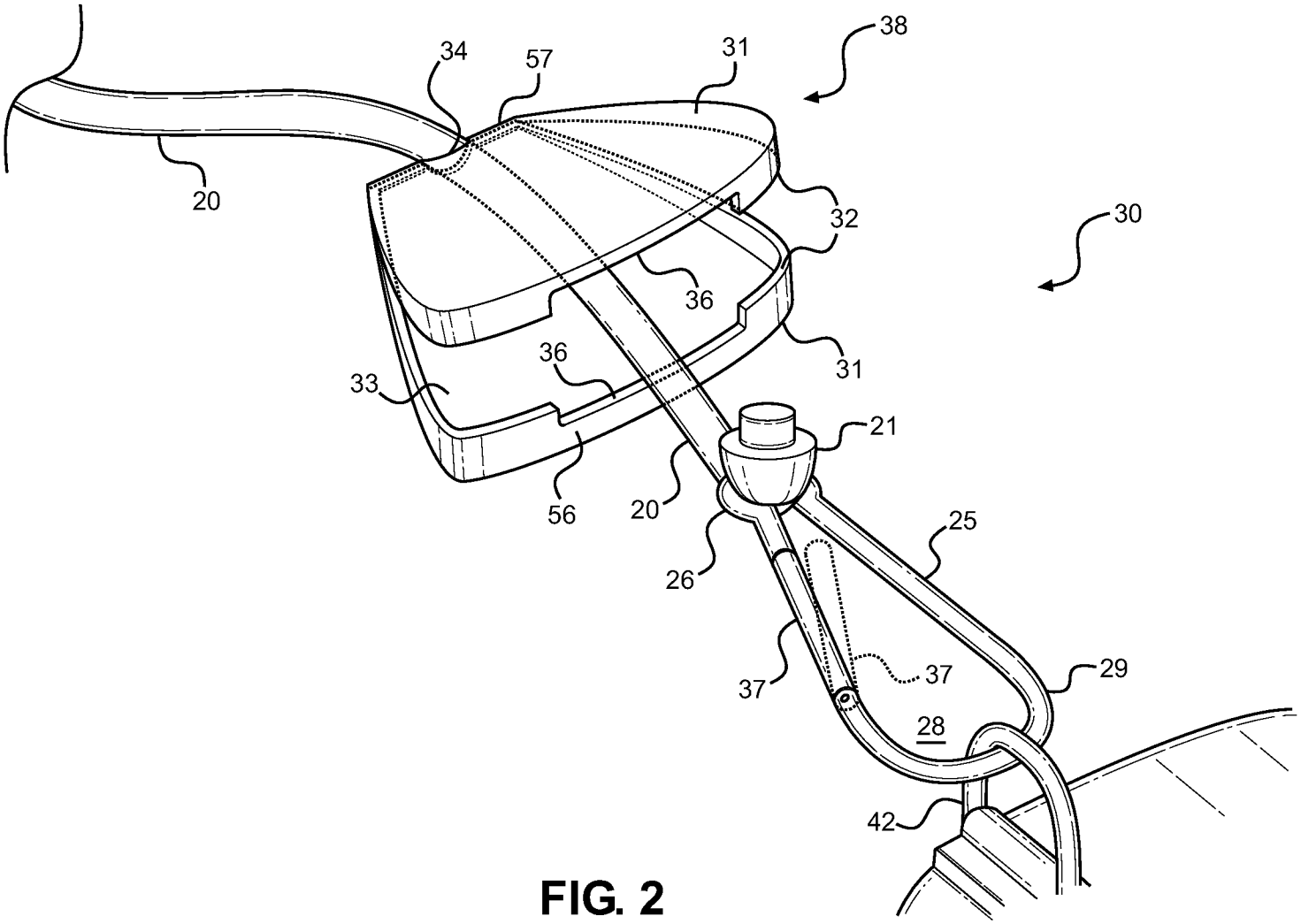
FIG. 2 shows a view of the resistance band retainer assembly in a partially open position.

Referring now to FIG. 2, there is shown a close-up view of the retainer assembly 30 of the present invention. The retainer assemblies 30 support the ends 21 of the resistance bands 20 and enclose the same such that the bands 20 do not inadvertently release from the D-links 42 on the given harness. Each assembly 30 comprises a ring retainer device 25 that is formed in the shape of a modified carabineer or clasp device. The ring 25 comprises a rounded bar member formed into an upper rounded portion 29 and a lower rounded portion 26. The ring 25 comprises a substantial "figure eight" shape, whereby the upper rounded portion 29 comprises a large rounded member with an enlarged interior opening through which the bulb 21 of the resistance band 20 is received. The band 20 can then be moved downward within the open interior of the ring and into the reduced interior of the lower rounded portion 26. The lower rounded portion 26 is a rounded member having a smaller diameter, and one sized to secure around the periphery of the resistance band with a close tolerance and prevent the bulb 21 from passing therethrough.

Therefore, the bulb 21 of the resistance band is first placed through the upper open portion 29 of the ring 25 to clear the bulb, and then the band 20 is pulled into the interior of the lower rounded portion 26 to lock the band therein. The ring 25 is secured to the D-link 42 of one of the harnesses by way of a hinged portion 37 along the side of the ring 25. The hinged portion allows the upper rounded portion to open along its periphery and accept the D-link 42 therethrough and into the interior 28 of the upper rounded portion 29. The hinged portion 37 is biased to return to its position enclosing the open interior 28 of the upper rounded portion 29, in a similarly manner found in other biased clasps.

Once the bulb end 21 of the resistance band 20 is secured within the retainer ring 25, the connection is further secured using the clamshell retainer housing 38. The housing 38 comprises a first and second half 31 having a hinged first end 57 and an open interior 33 sized to receive the ring 25 and bulb end 21 therein. The two halves 31 of the housing snap together along their raised peripheral edges 32, whereby a suitable connector and latch is provided that secures the halves 31 together and over the ring 25 and resistance band end 21.

Along the first end 57 of the housing 38, the two halves are connected at a hinge joint. Also disposed along the first end is a band opening 34 that allows the bulb end 21 and the length of the band 20 to insert therein when the two halves 31 are opened. The band opening 34 is rounded and is divided between the two halves 31 such that the bulb end 21 can insert therethrough only when the halves 31 are in an open state and the size of the band opening 34 is at its maximum. Along the second end 56 of the housing 38 is a retainer ring opening 36 that is sized to receive the upper end of the upper rounded portion 29 therethrough. This allows the housing 38 to secure over the ring 25 while the upper rounded portion 29 is exposed and affixed to the adjacent D-link 42.

Figure 3:
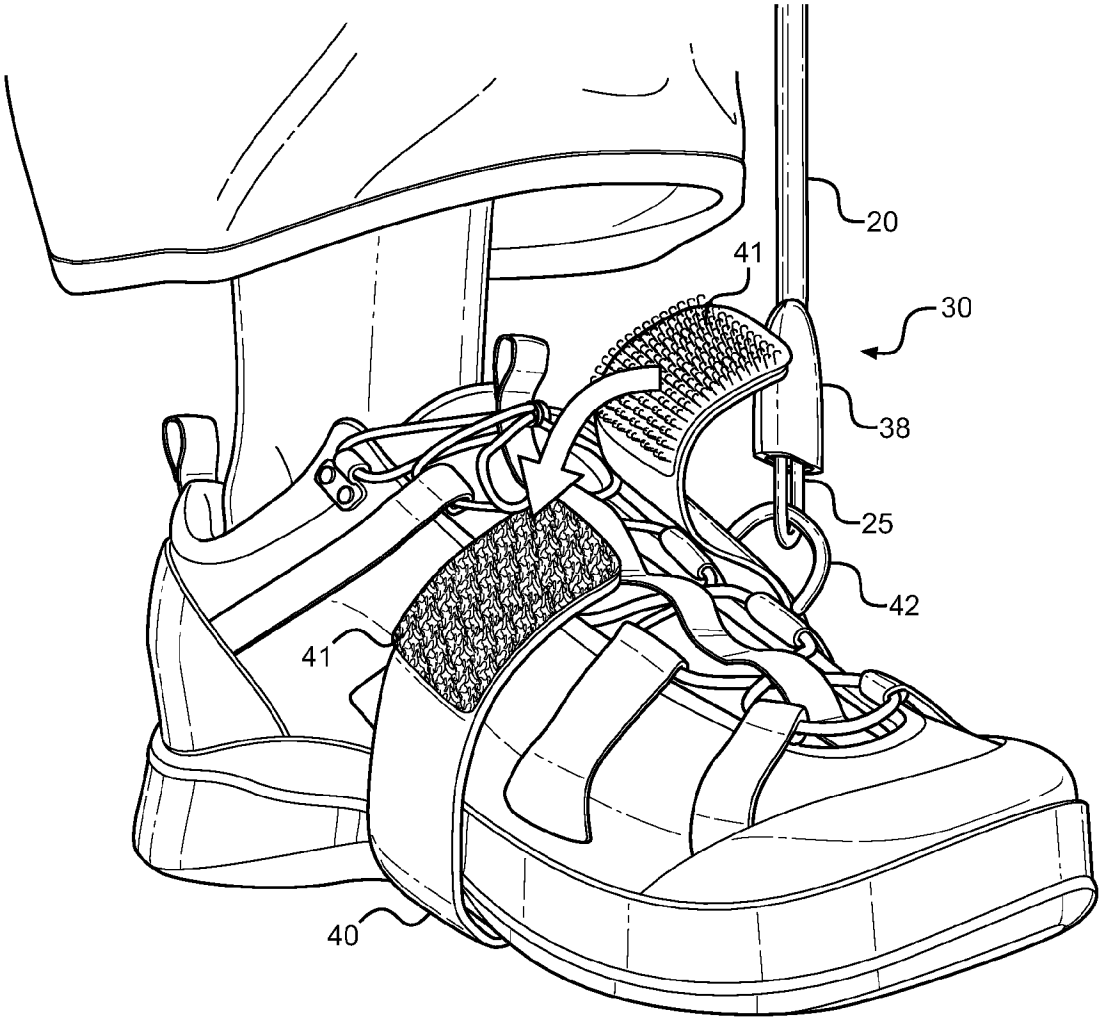
FIG. 3 shows a view of the limb harness being secured to the foot of a wearer.

Referring now to FIG. 3, there is shown a view of a user's foot and the limb harness 40 being applied therearound prior to the commencement of an exercise routine involving the resistance bands 20. First, the limb and waist harnesses are applied to the user (or a pair of limb harnesses alone). The ends of the harnesses are positioned around the specific portion of the body and secured using the harness fasteners 41. From the harness, at least one D-link 42 is provided such that a resistance band retainer assembly 30 can be secured thereto. To secure the resistance band at the harness D-link location, the retainer ring 25 if clamped thereto using the hinged portion 37 as a means to place the D-link 42 within the interior of the ring lower rounded portion. Thereafter, the bulb end of the resistance band is secured within the upper rounded portion of the ring retainer, whereafter the clamshell housing 38 is snapped thereover. This secures the resistance band 20 to the D-link 42 and provides an anchor point for the end of the resistance band at the position of the harness. The user can then engage in various stretching and exercise movements by stretching the band (or bands) between the different portions of the body supporting each band.

Figure 4:
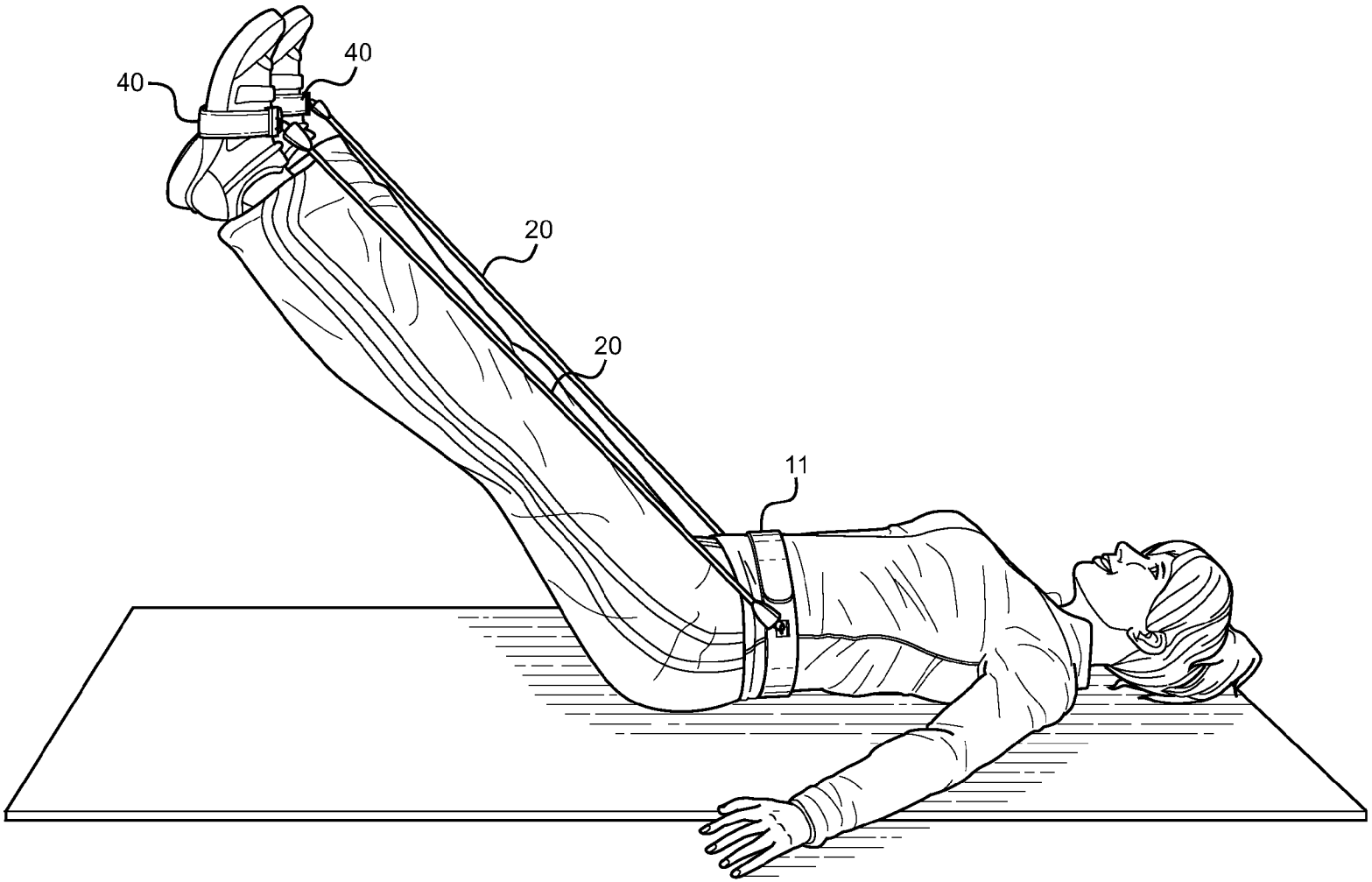
FIG. 4 shows a view of the typical use of the present invention.

Referring finally to FIG. 4, there is shown a representative view of a pair of resistance bands 20 being used between the waist harness 11 and the limb harnesses 40 of the present invention. The limb harnesses 40 are secured to the feet of the user, while the waist harness 11 is secured around the torso of the wearer. The resistance bands 20 are disposed therebetween and are elongated to tension the user's muscles, either for stretching or for physical exercise purposes. Overall, the present invention helps develop stronger muscles in the core and limb areas, thereby improving overall health, limberness, and physical strength. The device provides a portable and readily deployed design, thus allowing individuals to exercise in various locations with a minimal setup. The device can be utilized by teenagers, adults and both men and women of varying fitness levels, and can be used in various configurations, with various movements and routines as desired by the user.

It is submitted that the instant invention has been shown and described in what is considered to be the most practical and preferred embodiments. It is recognized, however, that departures may be made within the scope of the invention and that obvious modifications will occur to a person skilled in the art. With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A resistance training device, comprising:

at least two body harnesses, each comprising an elongated harness length, a first end, a second end, and a fastener that secures said first end and said second end together to form each body harness into a closed loop;

at least one resistance band having an elongated, elastic band length, a first end, and a second end;

the first end and the second end of each resistance band each comprises a bulb portion of increased thickness;

at least one link attachment point disposed along each of said body harnesses;

a pair of retainer assemblies for each said at least one resistance band;

said retainer assemblies comprising:

a retainer ring with an open interior configured to receive and secure the bulb portion of at least one resistance band therein;

a clamshell housing having two halves and an interior volume;

the clamshell housing being sized to secure over said retainer ring and said secured bulb portion and enclose the same within its interior volume;

each retainer ring having a hinged portion to provide access to its open interior when securing each retainer ring to one of said at least one link attachment point.

2. The resistance training device of claim 1, wherein:

each said retainer ring comprises a lower rounded portion and an upper rounded portion;

said upper rounded portion having an upper open interior;

said lower rounded portion having a lower open interior;

said upper open interior having a greater area than said lower open interior, and said upper open interior and said lower open interior being connected such that said band length can be transitioned from said upper open interior to said lower open interior without removal from said open interior of said retainer ring;

said lower open interior sized to prevent said bulb portion from passing therethrough;

said upper open interior sized to allow said bulb portion to pass therethrough.

3. The resistance training device of claim 1, wherein:

said clamshell housing further comprises a first end and a second end;

said first end of the clamshell housing further comprising a hinge joint joining the two halves together;

said first end of the clamshell housing also having an opening to receive one of said at least one resistance band and one bulb portion therethrough;

said second end of the clamshell housing further comprising a retainer ring opening sized to allow a portion of the retainer ring to extend therethrough and make connection with one of said at least one link attachment point.

4. The resistance training device of claim 1, wherein said at least one link attachment point further comprises a D-link.

5. The resistance training device of claim 1, wherein the fastener of each body harness further comprises hook and loop fasteners.

6. The resistance training device of claim 1, wherein the at least two body harnesses comprise one waist harness and one or more limb harnesses, or two or more limb harnesses.

* * * * *